US006412474B1

(12) United States Patent
Guentert et al.

(10) Patent No.: US 6,412,474 B1
(45) Date of Patent: Jul. 2, 2002

(54) RADIAL PISTON PUMP FOR PRODUCING HIGH FUEL PRESSURE INTERNAL COMBUSTION ENGINES

(75) Inventors: Josef Guentert, Gerlingen; Hans-Juergen Simon, Bad Liebenzell, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/623,429

(22) PCT Filed: Feb. 9, 1999

(86) PCT No.: PCT/DE99/00345

§ 371 (c)(1),
(2), (4) Date: Nov. 3, 2000

(87) PCT Pub. No.: WO99/45271

PCT Pub. Date: Sep. 10, 1999

(30) Foreign Application Priority Data

Mar. 5, 1998 (DE) ..... 198 09 315

(51) Int. Cl.[7] ..... F02M 37/04
(52) U.S. Cl. ..... 123/456; 123/495
(58) Field of Search ..... 123/456, 495, 123/446, 510; 92/129

(56) References Cited

U.S. PATENT DOCUMENTS

| | | | | |
|---|---|---|---|---|
| 3,857,642 A | * | 12/1974 | Miller | 403/57 |
| 5,364,234 A | * | 11/1994 | Eickmann | 417/273 |
| 5,983,863 A | * | 11/1999 | Cavanagh et al. | 123/447 |
| 6,176,223 B1 | * | 1/2001 | Kuhn et al. | 123/495 |
| 6,311,674 B1 | * | 11/2001 | Igashira et al. | 123/458 |
| 6,345,609 B1 | * | 2/2002 | Djordjevic | 123/509 |

* cited by examiner

*Primary Examiner*—Carl S. Miller
(74) *Attorney, Agent, or Firm*—Ronald E. Greigg

(57) ABSTRACT

The invention relates to a radial piston pump with a drive shaft supported in a pump housing and preferably with a number of pistons, each in its own cylinder chamber, arranged radially with regard to the drive shaft, and with a plate attached to the ends of these cylinders oriented toward the drive shaft, which plate has a blind hole in its center for receiving the end of the associated piston, wherein on its circumference, the piston has a groove into which a snap ring is inserted in order to fasten a plate retainer to the piston, which holds the plate on the piston, which is characterized in that at the rim of the blind hole in the plate, a cylindrical recess is produced, wherein the diameter of the cylindrical recess is dimensioned so that the play between the snap ring and the circumference of the cylindrical recess is smaller than the depth of the groove.

25 Claims, 6 Drawing Sheets

(Stand der Technik)

RADIAL PISTON PUMP FOR PRODUCING HIGH FUEL PRESSURE INTERNAL COMBUSTION ENGINES

BACKGROUND OF THE INVENTION

Field of the Invention

The invention relates to a radial piston pump for producing high fuel pressure in fuel injection systems of internal combustion engines, particularly in a common rail injection system, with a drive shaft supported in a pump housing, which shaft is embodied eccentrically or has cam-like projections in the circumference direction, and preferably with a number of pistons, each in its own cylinder chamber, arranged radially with regard to the drive shaft, and with a plate attached to the ends of these cylinders oriented toward the drive shaft, which plate has a blind hole in its center which receives the end of the associated piston, and on its circumference, the piston has a groove into which a snap ring is inserted in order to fasten a plate retainer to the piston, which holds the plate on the piston.

With a partial filling of the cylinder chambers, the components of the radial piston pump that are exposed to high pressure undergo an extremely high amount of stress.

SUMMARY OF THE INVENTION

In accordance with the present invention a radial piston pump provided which can withstand the pressures of up to 2000 bar that occur with a partial filling of the cylinder chambers and nevertheless can be easily and inexpensively manufactured.

In a radial piston pump for producing high fuel pressure in fuel injection systems of internal combustion engines, in particular in a common rail injection system, with a drive shaft supported in a pump housing, which shaft is embodied eccentrically or has cam-like projections in the circumference direction, and preferably with a number of pistons, each in its own cylinder chamber, arranged radially with regard to the drive shaft, and with a plate attached to the ends of these cylinders oriented toward the drive shaft, which plate has a blind hole in its center for receiving the end of the associated piston, and on its circumference, the piston has a groove into which a snap ring is inserted in order to fasten a plate retainer to the piston, which holds the plate on the a piston, the object of the invention is attained by virtue of the fact that at the rim of the blind hole in the plate, a cylindrical recess is produced, where the play between the snap ring and the circumference of the cylindrical recess is smaller than the depth of the groove. The cylindrical recess is used to contain the snap ring, or more precisely stated, to contain the part of the snap ring which protrudes from the groove. The dimensioning of the cylindrical recess according to the invention achieves the fact that the snap ring is contained in captive fashion in its space. As a result, greater forces can be transmitted than in conventional radial piston pumps.

One particular embodiment of the invention is characterized in that the radius of the groove is greater than the radius of the snap ring. This dimensioning of the groove and of the snap ring produces the advantage that the snap ring always rests against the bottom of the groove and not against the edges of the groove. As a result, damage to the seat is prevented and the initial stress of the snap ring can be optimally utilized. The initial stress of the snap ring can be increased by increasing the thickness and diameter of the snap ring as well as the diameter of the groove.

Another particular embodiment of the invention is characterized in that the region of the plate retainer that rests against the snap ring expands radial to the piston and is embodied as flat. As a result, the snap ring can be seen better before the plate is inserted into the plate retainer. This results in the fact that installation is simplified and errors are prevented in the assembly of the radial piston pump according to the invention. Consequently, valuable time can be saved and the goal of zero errors can be better attained.

Another particular embodiment of the invention is characterized in that a step is embodied on the plate retainer. The step is advantageously used to center a spring which is used to prestress the plate toward the drive shaft.

Another particular embodiment of the invention is characterized in that on its circumference, the plate has a groove which contains a securing ring which rests against the plate retainer. The elastic securing ring produces a frictional and consequently play-free connection between the plate retainer and the plate. This assures that the piston base remains in contact with the plate during operation. During insertion of the plate into the plate retainer, the securing ring flexes so that the plate retainer can be embodied as rigid.

Another particular embodiment of the invention is characterized in that snap segments are embodied on the plate retainer, which rest against the circumference of the plate. In comparison to the claws known from the prior art, the snap segments have the advantage that they are more stable as a result of their size. Furthermore, the snap segments of one plate retainer do not interlock as easily with the snap segments of other plate retainers during storage. This facilitates the installation of the plate retainers.

Another particular embodiment of the invention is characterized in that the ends of the snap segments are each bent slightly outwards. As a result, the installation of the plate is advantageously simplified because during insertion of the plate into the plate retainer, the snap segments that are bent slightly outwards automatically spread out.

Another particular embodiment of the invention is characterized in that the ends of the snap segments each have a bevel. This produces the same effect as the snap segments that are bent slightly outwards. The installation of the plate is simplified.

Another particular embodiment of the invention is characterized in that a polygonal or cylindrical ring is disposed between the drive shaft and the plate. The ring is used to transmit forces from the eccentrically embodied drive shaft onto the plate. The ring is advantageously supported against the drive shaft in a sliding fashion. The ring can be embodied either cylindrically or with flattened places.

In general, the current invention has the advantage that the basic concept of this invention can easily be used on existing radial piston pumps. Generally, the component strength is increased, particularly at a zero delivery in the intake stroke, without increasing the space of the radial piston pump.

BRIEF DESCRIPTION OF THE DRAWINGS

Other advantages, features, and details of the invention are described in detail with specific reference with the drawings. In wich

DESCRIPTION OF THE PREFERRED EMBODIMENT

Figure 1:
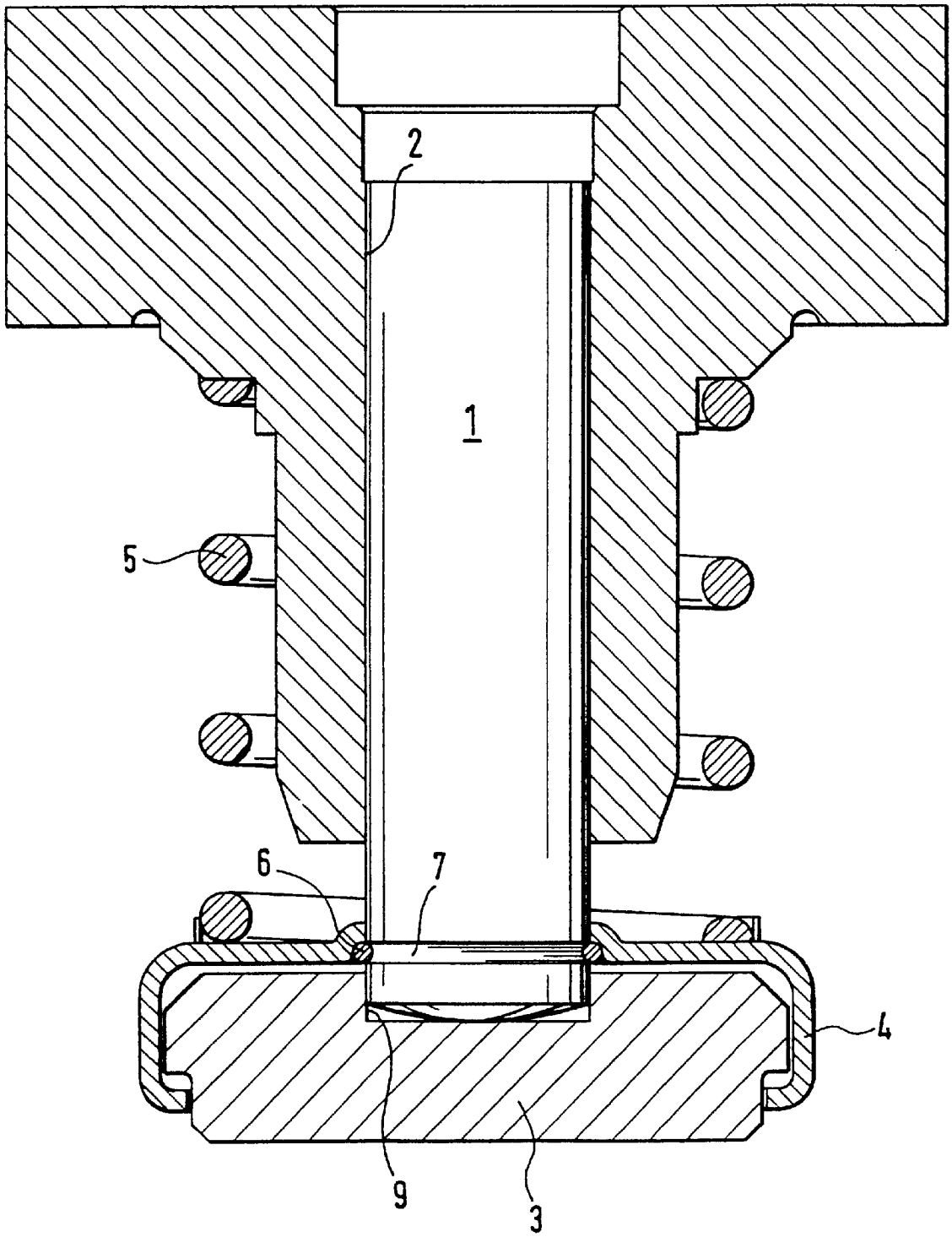
FIG. 1 shows a piston and a plate of a conventional radial piston pump.

Referring now to the drawings in detail; FIG. 1 shows a sectional view that portion only of a conventional radial piston pump for producing high fuel pressure in fuel injection systems of internal combustion engines. That relates to the current invention. The principal design of a radial piston pump, for example from the German patent DE 42 16 988 C2, is assumed to be known and is therefore only briefly described below.

The radial piston pump according to the invention is particularly used in common rail injection systems for fuel delivery in diesel engines. In this connection "common rail" means the same thing as "common line" or "common distributor rail". In contrast to conventional high-pressure injection systems in which the fuel is delivered to the individual combustion chambers by means of separate lines, the fuel injectors in common rail injection systems are supplied from a common line.

The radial piston pump, a detail of which is shown in FIG. 1, includes a drive shaft that is supported in a pump housing and has an eccentrically embodied shaft section. A polygonal ring is provided on the eccentric shaft section and the shaft section can rotate in relation to this ring. The ring includes a number of flattened places that are offset from one another, each of which supports a piston 1. The pistons 1 are each contained so that they can move back and forth in a cylinder chamber 2 in the radial direction in relation to the drive shaft.

As shown in FIG. 1, a plate 3 is fastened to the end of the piston 1 oriented toward the drive shaft. The plate 3 is secured to the associated piston 1 by means of a plate retainer 4, which is embodied as a cage or spring plate. In addition, the plate 3 is pressed against the ring (not shown) by means of a spring 5. In order to prevent the plate retainer 4 from slipping off of the piston 1, a snap ring 6 is inserted into a groove 7 of the piston 1.

Figure 2C:
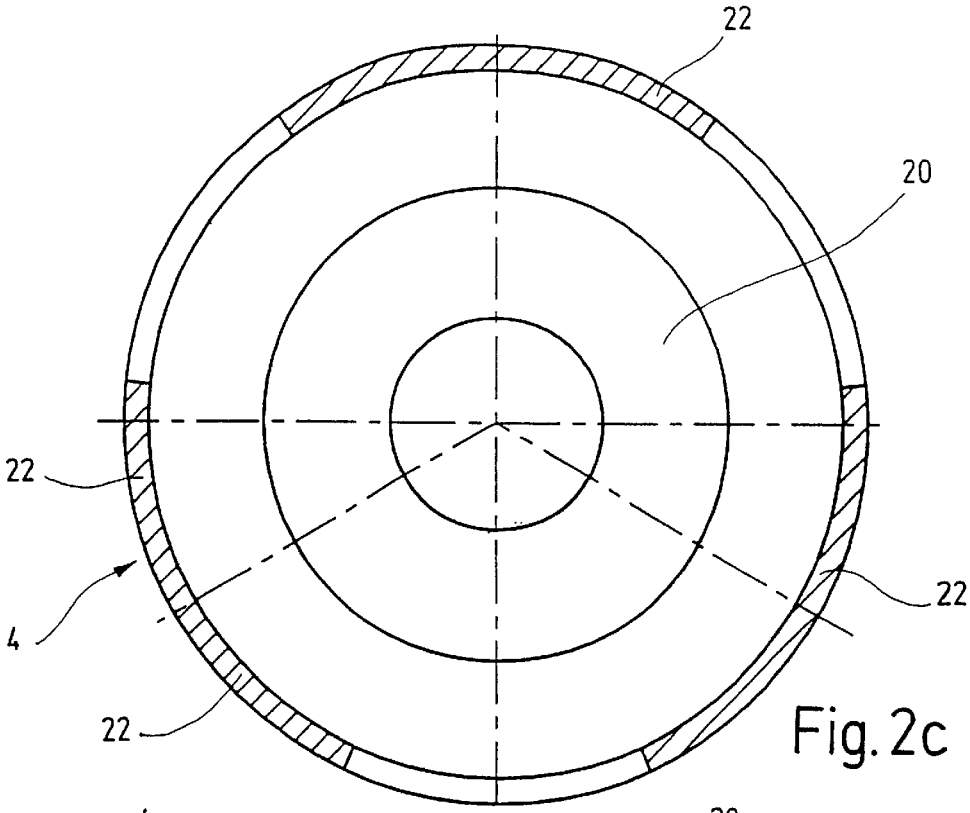
FIG. 2*a*, 2*b* and 2*c* show a piston and a plate of a radial piston pump according to a first embodiment of the current invention.
Figure 2B:
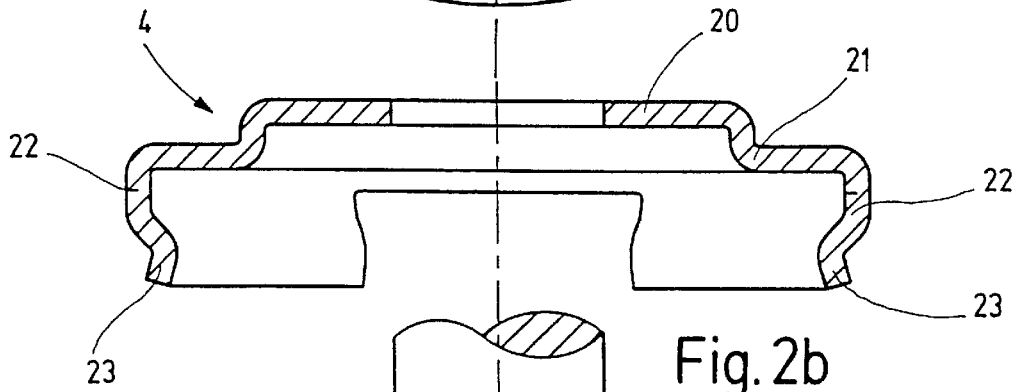
Figure 2A:
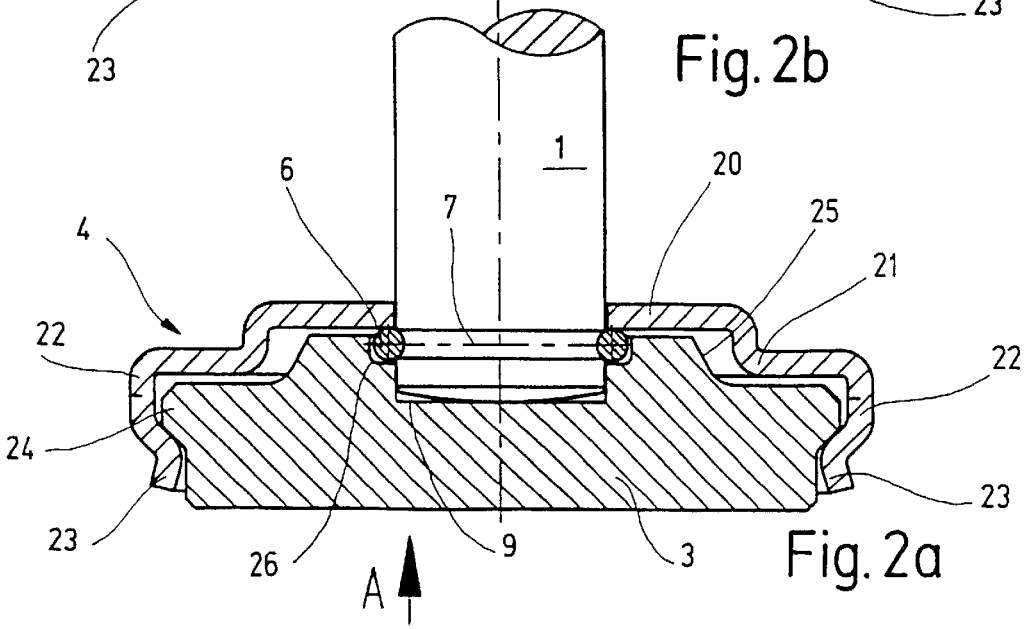

FIG. 2 is divided into FIGS. 2*a*, 2*b*, and 2*c*. FIG. 2*a* shows a section of a radial piston pump according to the invention, which is similar to the one depicted in FIG. 1 in terms of design. Thus for the sake of simplicity, parts which appear in both FIGS. are given the same reference numerals. FIG. 2*b* shows only the plate retainer from FIG. 2*a*. FIG. 2*c* shows a view of the plate retainer in the direction of the arrow A in FIG. 2*a*.

A plate 3 is affixed to the piston 1 shown in FIG. 1. The plate 3 is secured to the piston 1 by means of a plate retainer 4. To this end, a snap ring 6 is installed in a groove 7, which is provided on the circumference of the piston 1. In addition, the plate retainer 4 is pressed against the snap ring 6 by means of the spring (5 as shown in FIG. 1).

The plate 3 has a blind hole bore 9 in the center, which receives one end of the piston 1 with form-fitting engagement. The rim of the blind hole 9 is provided with a cylindrical recess 26. The cylindrical recess 26 is used to contain that part of the snap ring 6 that protrudes from the groove 7.

Figure 5:
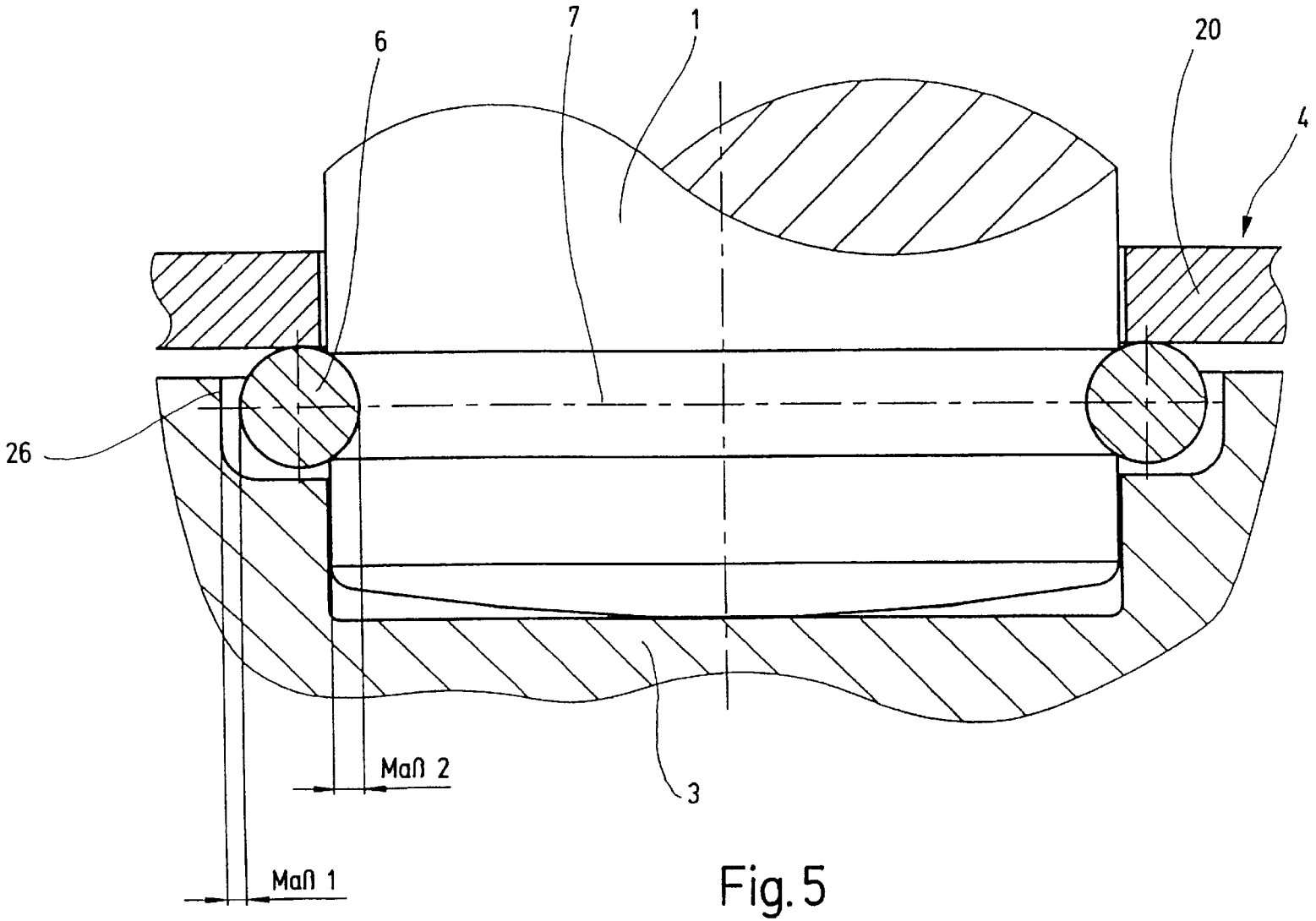
FIG. 5 shows an enlarged depiction of the snap ring in the cylindrical recess.

FIG. 5 is an enlarged depiction of the snap ring 6 and the cylindrical recess 26. The tolerances are selected according to the invention so that the snap ring 6 is always disposed in the recess 26. The measurement 1 is designed so that even with an unfavorable tolerance situation, is always smaller than the measurement 2. As a result, the snap ring 6 is contained in the recess 26 in captive fashion and cannot slip off of the piston 1.

Figure 6:
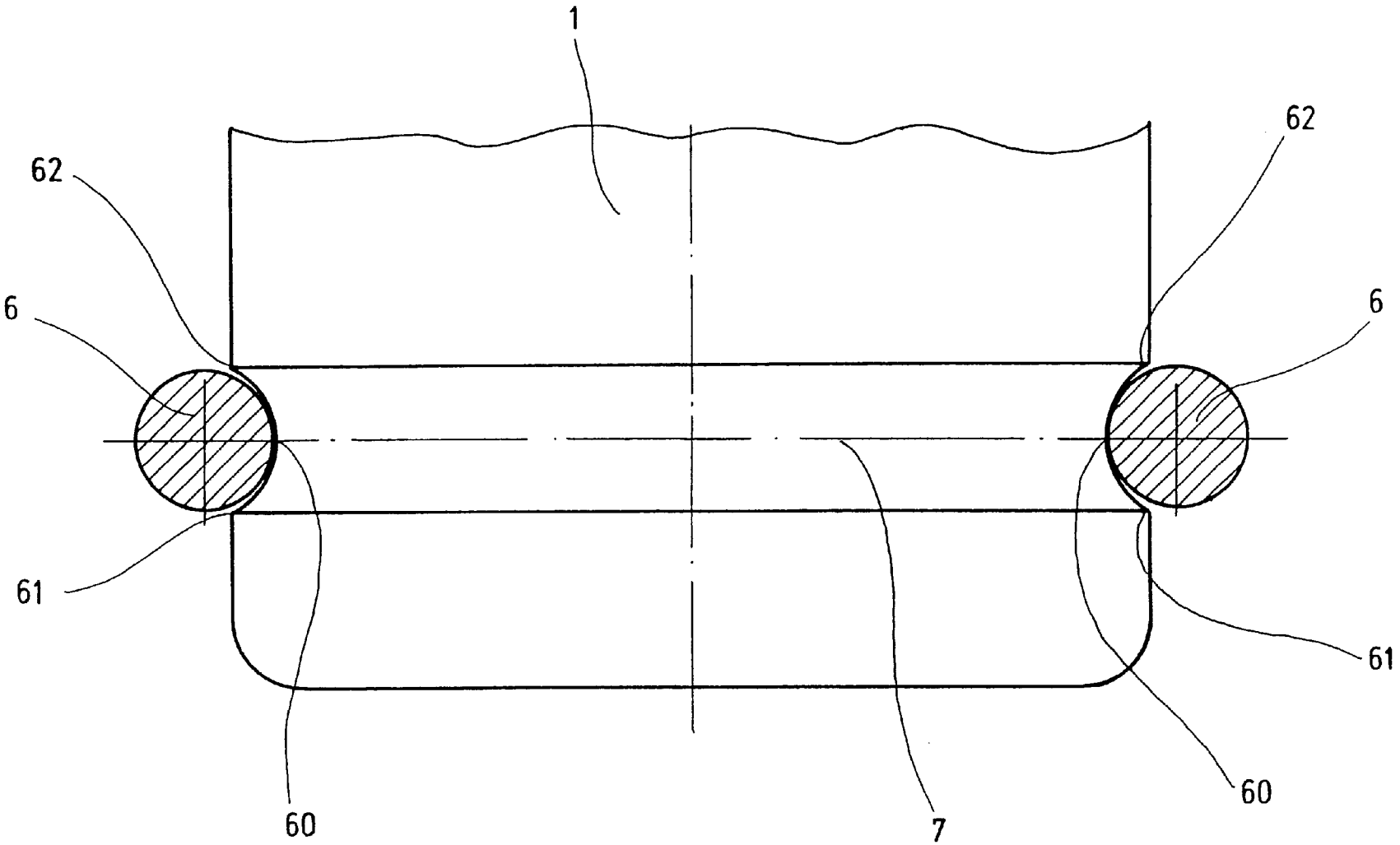
FIG. 6 shows an enlarged depiction of the snap ring in the groove.

FIG. 6 is an enlarged depiction of the dimensioning of the snap ring 6 and groove 7. The tolerances of the groove 7 and the snap ring 6 are selected so that the snap ring 6 always rests against the groove bottom 60 and not against the edges 61, 62 of the groove 7. This prevents damage to the seat. The wire diameter of the snap ring 6, the diameter of the snap ring 6, and the diameter of the groove are increased in comparison to the embodiment shown in FIG. 2. As a result, a higher snap ring initial tension can be produced than in the embodiment according to FIG. 1.

In the radial piston pump shown in FIG. 2*a*, the region of the plate retainer 4 which rests against the piston 1 has the form of a round disk 20, which extends radial to the piston 1. This results in the fact that the groove 7 can be looked into before the plate 3 is inserted into the plate retainer 4. The disk-shaped region 20 is adjoined by a step 21, which is embodied on the circumference of the round disk 20. The plate 3 is equipped with a bevel 25, which is spaced apart from the step 21.

Three snap segments 22 extend from the step 20, parallel to the piston 1. The ends 23 of the snap segments 22 first bend inward and then bend slightly outward. The bent-inward part of the snap segments 22 forms an annular chamber that is disposed inside the plate retainer 4 and serves to contain a collar 24, which is embodied on the plate 3. The bent-outward end pieces 23 of the snap segments 22 facilitate the insertion of the plate 3 into the plate retainer 4.

Figure 3:
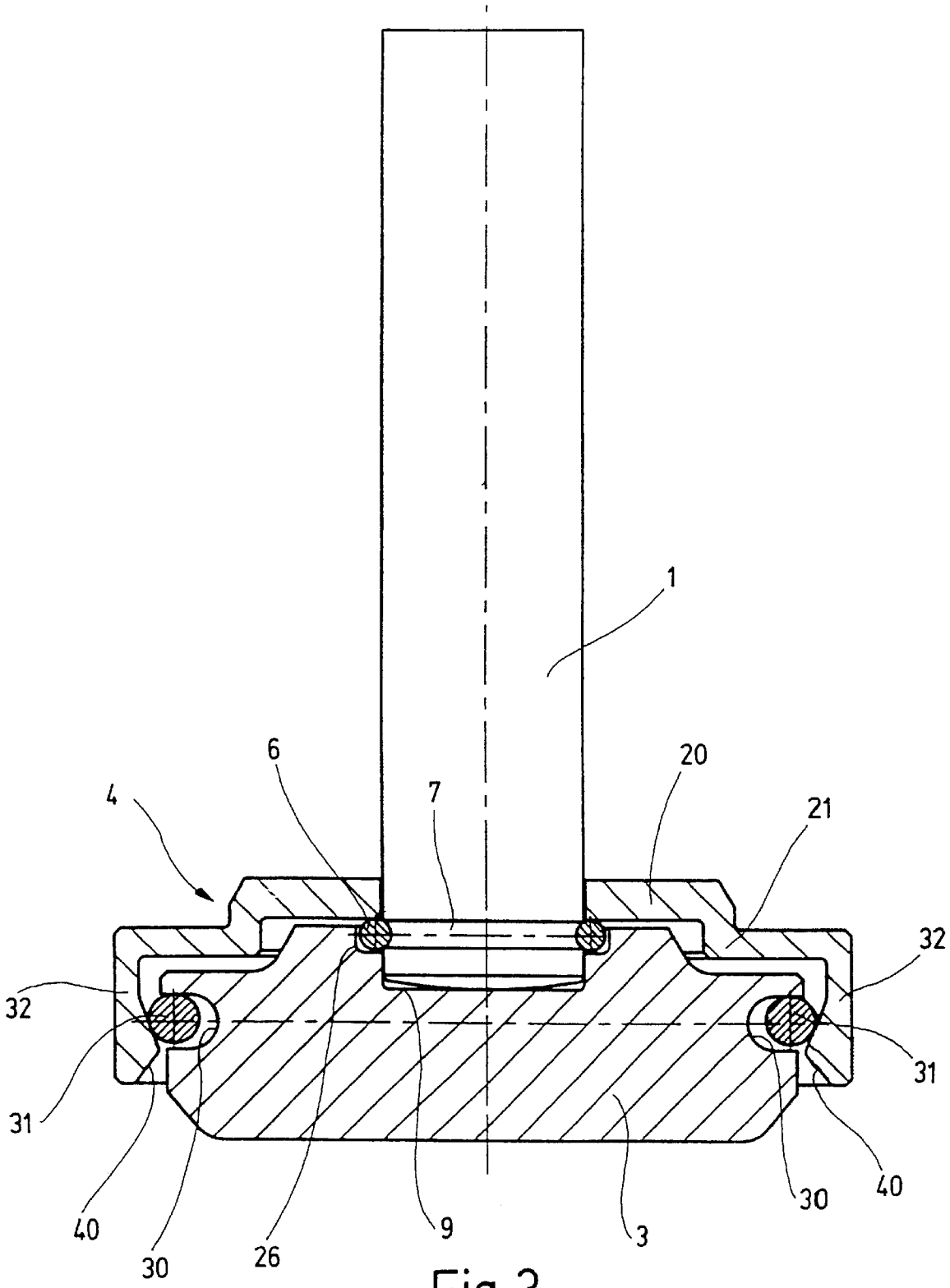
FIG. 3 shows a piston and a plate of a radial piston pump according to a second embodiment of the current invention.

In the embodiment shown in FIG. 3, only a section of a piston 1 is shown, as in FIG. 2*a*. The end of the piston 1 is contained in a blind hole 9, which is let into the center of a plate 3. The plate 3 is secured to the piston 1 by means of a plate retainer 4. The plate retainer 4 is fastened to the piston 1 by means of a snap ring 6. The snap ring 6 is partially contained in a groove 7 of the piston 1 and partially contained in a cylindrical recess 26 of the plate 3. The plate retainer 4 is a turned part in which a step 21 is embodied. A continuous collar 32 extends from the step 21, parallel to the piston 1. The rim of the collar 32 of the plate retainer 4 is provided with a bevel 40, which facilitates the installation of the plate 3.

A groove 30 is let into the circumference of the round plate 3 and contains a securing ring 31. The securing ring 31 is embodied as resilient and can be pressed into the groove 30 during installation of the plate 3. This has the advantage that the plate retainer 4 can be provided with the continuous collar 32 and can be embodied as rigid.

Figure 4:
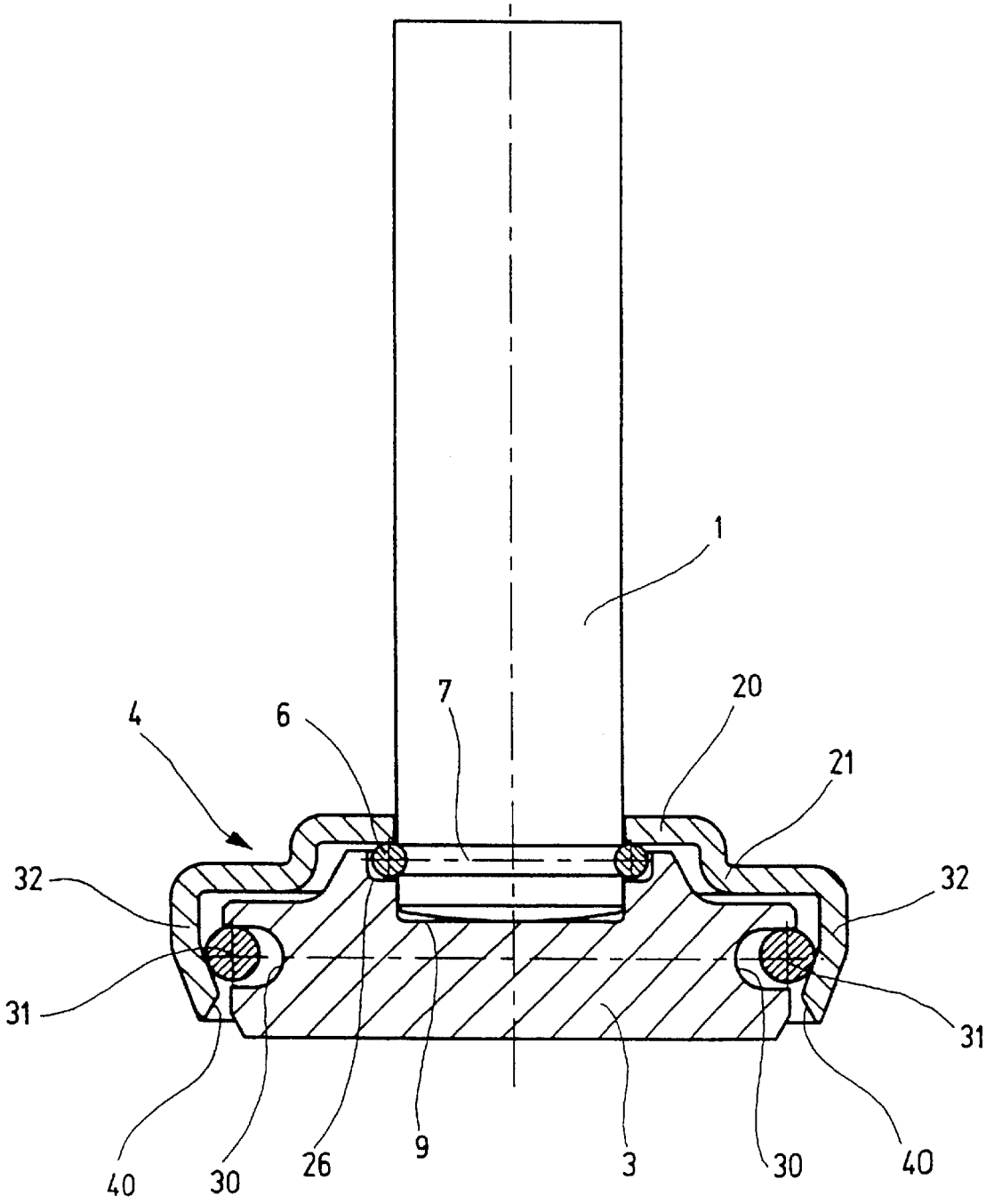
FIG. 4 shows a piston and a plate of a radial piston pump according to a third embodiment of the current invention.

In contrast to the embodiment shown in FIG. 3, in the section of another embodiment of the radial piston pump according to the invention shown in FIG. 4, the plate retainer 4 is embodied as a deep-drawn part with rounded edges. In addition, the rim of the collar 32 of the plate retainer 4, as shown in the embodiment in FIG. 3, is provided with a bevel 40 which facilitates the installation of the plate 3.

The radial piston pump, of which only parts are shown in FIGS. 1 to 6, is used to exert high pressure on a fuel that is supplied from a tank by a presupply pump. The highly pressurized fuel is then fed into the common distributor rail mentioned above.

The foregoing relates to preferred exemplary embodiments of the invention, it being understood that other variants and embodiments therefore are possible within the spirit and scope of the invention, the latter being defined by the appended claims.

We claim:

1. A radial piston pump for producing high fuel pressure in fuel injection systems of internal combustion engines, in particular in a common rail injection system, with a drive shaft supported in a pump housing, which shaft is embodied eccentrically or has cam-like projections in the circumference direction, and preferably with a number of pistons (1), each in its own cylinder chamber (2), arranged radially with regard to the drive shaft, and with a plate (3) attached to the ends of these cylinders oriented toward the drive shaft, which plate (3) has a blind hole (9) in its center for receiving the end of the associated piston (1), wherein on its circumference, the piston (1) has a groove (7) into which a snap ring (6) is inserted in order to fasten a plate retainer (4) to the piston (1), which holds the plate (3) on the piston (1), the improvement wherein at the rim of the blind hole (9) in the plate (3), a cylindrical recess (26) is provided, the diameter of said cylindrical recess (26) being dimensioned so that the play between the snap ring (6) and the circumference of the cylindrical recess (26) is smaller than the depth of the groove (7).

2. The radial piston pump according to claim 1, wherein the radius of the groove (7) is greater than the wire radius of snap ring (6).

3. The radial piston pump according to claim 1, wherein the region (20) of the plate retainer (4) that rests against the snap ring (6) expands radial to the piston (1) and is embodied as flat.

4. The radial piston pump according to claim 1, wherein a step (21) is embodied on the plate retainer (4), adjoining a disk-shaped region (20) radially on the outside.

5. The radial piston pump according to claim 1, wherein on its circumference, the plate (3) has a groove (30) into which a securing ring (31) is inserted, which rests against the plate retainer (3).

6. The radial piston pump according to claim 1, wherein snap segments (22) are embodied on the plate retainer (3), said snap segments resting against the circumference of the plate (3).

7. The radial piston pump according to claim 6, wherein the ends (23) of said snap segments (22) are each embodied as bent slightly outward.

8. The radial piston pump according to claim 6, wherein the ends (40) of said snap segments (22) each have a bevel.

9. The radial piston pump according to claim 1, further comprising a polygonal or cylindrical ring disposed between the drive shaft and the plate (3).

10. The radial piston pump according to claim 2, wherein the region (20) of the plate retainer (4) that rests against the snap ring (6) expands radial to the piston (1) and is embodied as flat.

11. The radial piston pump according to claim 2, wherein a step (21) is embodied on the plate retainer (4), adjoining a disk-shaped region (20) radially on the outside.

12. The radial piston pump according to claim 3, wherein a step (21) is embodied on the plate retainer (4), adjoining a disk-shaped region (20) radially on the outside.

13. The radial piston pump according to claim 2, wherein on its circumference, the plate (3) has a groove (30) into which a securing ring (31) is inserted, which rests against the plate retainer (3).

14. The radial piston pump according to claim 3, wherein on its circumference, the plate (3) has a groove (30) into which a securing ring (31) is inserted, which rests against the plate retainer (3).

15. The radial piston pump according to claim 4, wherein on its circumference, the plate (3) has a groove (30) into which a securing ring (31) is inserted, which rests against the plate retainer (3).

16. The radial piston pump according to claim 2, wherein snap segments (22) are embodied on the plate retainer (3), said snap segments resting against the circumference of the plate (3).

17. The radial piston pump according to claim 3, wherein snap segments (22) are embodied on the plate retainer (3), said snap segments resting against the circumference of the plate (3).

18. The radial piston pump according to claim 4, wherein snap segments (22) are embodied on the plate retainer (3), said snap segments resting against the circumference of the plate (3).

19. The radial piston pump according to claim 2, further comprising a polygonal or cylindrical ring disposed between the drive shaft and the plate (3).

20. The radial piston pump according to claim 3, wherein the region (20) of the plate retainer (4) that rests against the snap ring (6) expands radial to the piston (1) and is embodied as flat.

21. The radial piston pump according to claim 4, wherein a step (21) is embodied on the plate retainer (4), adjoining a disk-shaped region (20) radially on the outside.

22. The radial piston pump according to claim 5, wherein a step (21) is embodied on the plate retainer (4), adjoining a disk-shaped region (20) radially on the outside.

23. The radial piston pump according to claim 6, wherein on its circumference, the plate (3) has a groove (30) into which a securing ring (31) is inserted, which rests against the plate retainer (3).

24. The radial piston pump according to claim 7, wherein on its circumference, the plate (3) has a groove (30) into which a securing ring (31) is inserted, which rests against the plate retainer (3).

25. The radial piston pump according to claim 8, wherein on its circumference, the plate (3) has a groove (30) into which a securing ring (31) is inserted, which rests against the plate retainer (3).

* * * * *